US005172456A

United States Patent [19]

Samberg et al.

[11] Patent Number: 5,172,456

[45] Date of Patent: Dec. 22, 1992

[54] ZIPPER WITH FUSIBLE WOVEN YARN

[75] Inventors: Michael Samberg, Miami, Fla.; Thomas L. Allison, Gastonia, N.C.

[73] Assignee: Talon, Inc., Meadville, Pa.

[21] Appl. No.: 626,535

[22] Filed: Dec. 12, 1990

[51] Int. Cl.[5] ..... A44B 1/04; A44B 11/25; A44B 17/00; B32B 7/00

[52] U.S. Cl. ..... 24/397; 24/405; 24/435; 428/258; 428/259; 428/395

[58] Field of Search ..... 428/259, 258; 24/435, 24/397, 405; 156/66, 148; 425/814

[56] References Cited

U.S. PATENT DOCUMENTS 3,252,484 5/1966 Meyer et al. ..... 428/259
3,336,173 8/1967 Renfroe ..... 156/148
3,515,623 6/1970 Bates ..... 156/148
3,596,343 7/1971 Uhrig ..... 29/410
3,883,931 5/1975 Peterson ..... 24/435

*Primary Examiner*—George F. Lesmes
*Assistant Examiner*—Terrel Morris
*Attorney, Agent, or Firm*—Anthony A. O'Brien

[57] ABSTRACT

A mounting adapted to be attached to an article includes a woven material with front and rear slides and made by warp and weft yarns, one of the warp yarns being a thermoplastic coating on a supporting yarn center operative to heat seal the mounting tape to the article, some of the warp yarns showing a 3/1 combination weave pattern with the weft yarns and the remainder of the warp yarns having a 1/1 and 2/2 combination basic weave pattern with weft yarns resulting in at least one of the warp yarns being disposed on a side of the woven material and exhibiting a color shade contrasting with the color of the rest of the tape.

8 Claims, 2 Drawing Sheets

ZIPPER WITH FUSIBLE WOVEN YARN

BACKGROUND OF THE INVENTION

The present invention relates to a woven mounting tape and, more particularly, to such a mounting tape having a heat sealable portion for installation purposes. One useful purpose of the woven mounting tape is for installing a zipper or slide fastener to an article such as clothing, bags, etc. In addition, the present invention may be applied to any fabric edge or fabric portion.

DESCRIPTION OF THE PRIOR ART

Slide fastener tapes are, in some cases, heat sealed to plastic films or plastic coated cloth. Such tapes require a film of vinyl or the like to be laminated to the tape surface. However, this arrangement is expensive and requires a separate operation.

U.S. Pat. No. 3,515,623 describes a method of treating a fabric or yarns or fundamentally the resin prior to yarn extrusion to create yarns and fabrics that may be electronically heated (dielectrically) for bonding purposes. The problem with bonding fabrics is that the yarn at point, line or area of bonding must be melted and fused; this creates brittleness and is easily cracked in use and is unsuitable for continuing use.

U.S. Pat. No. 3,252,484 uses a double yarn of one non-thermoplastic and one thermoplastic yarn twisted together and woven into one direction of a fabric; the other direction employing non-thermoplastic yarn. The thermoplastic yarn element must then be solvent treated to lower the softening temperature for heat bonding to prevent scorching. The thus creating a strength limitation.

U.S. Pat. Nos. 3,336,173; 3,515,623; and, 3,596,343 are further examples of the prior art utilizing thermoplastic for fusible mountings.

SUMMARY OF THE INVENTION

A mounting for a fabric is disclosed as including a woven material formed of warp and weft yarns and having front and rear sides, at least one of the warp threads is coated with a thermoplastic so as to be fusible to the fabric, the one fusible warp yarn being exposed on the side of the woven material to be heat sealed.

OBJECTS OF THE INVENTION

An object of the present invention is to construct a yarn element of any textile material which has an outer coating of a thermoplastic resin.

Another object of the present invention is to construct a woven tape having vinyl coated warp yarns fusible with a fabric.

The present invention has another object in that the woven mounting tape of a slide fastener is provided with fusible yarns so as to be heat sealable during installation of the slide fastener.

It is another object of this invention to provide a woven tape with a portion of warp yarns which are fusible for installation purposes and which have a contrasting shade of color making the fusible portion readily apparent.

A further object of this invention is to provide a woven tape with a fusible portion formed with extruded plastic coated warp yarns, which portion may vary to include a tape width cover from a partial width to a total width.

The present invention has another object in that a mounting tape for a zipper or the like is constructed to utilize fusible yarns on a front side, a rear side or both front and rear sides.

Other objects and advantages will become apparent from the following detailed description taken in conjunction with accompanying drawings.

DETAILED DESCRIPTION

Figure 1:
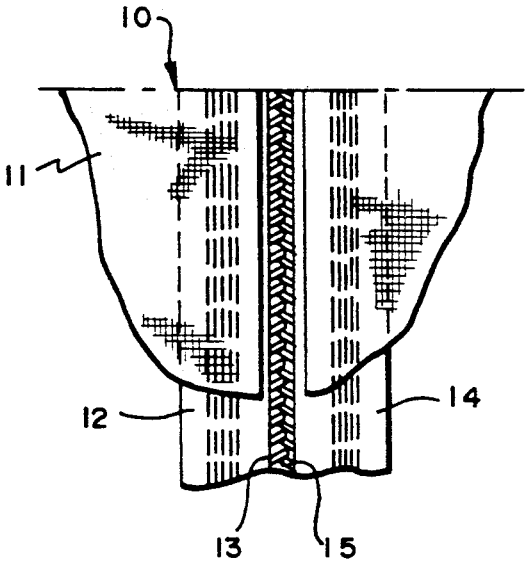
FIG. 1 is a front elevational view, partially broken away, of a zipper embodying the present invention.
Figure 2:
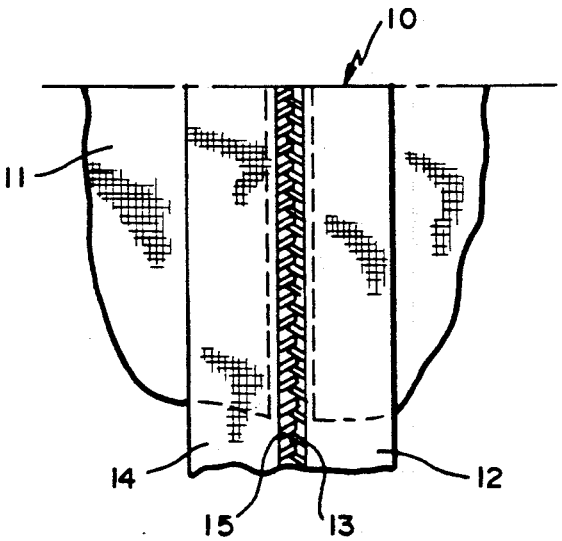
FIG. 2 is a rear elevational view, partially broken away, of FIG. 1.

The present invention is embodied in a zipper (also called a slide fastener), indicated generally at 10 in FIGS. 1 and 2 for attachment to an article 11, having a pair of woven mounting tapes 12 and 14. A first series of coupling elements 13 are carried on an edge of tape 12 and a second series of coupling elements 15 are carried on an edge of tape 14; as is well known in the art, the coupling elements 13 and 15 intergage with each other to form a zipper for the article 11. A conventional slider (not shown) as disclosed in U.S. Pat. No. 3,793,683 dated Feb. 26, 1974, selectively engages and disengages the coupling elements 13 and 15 to open and close the zipper 10.

Figure 3:
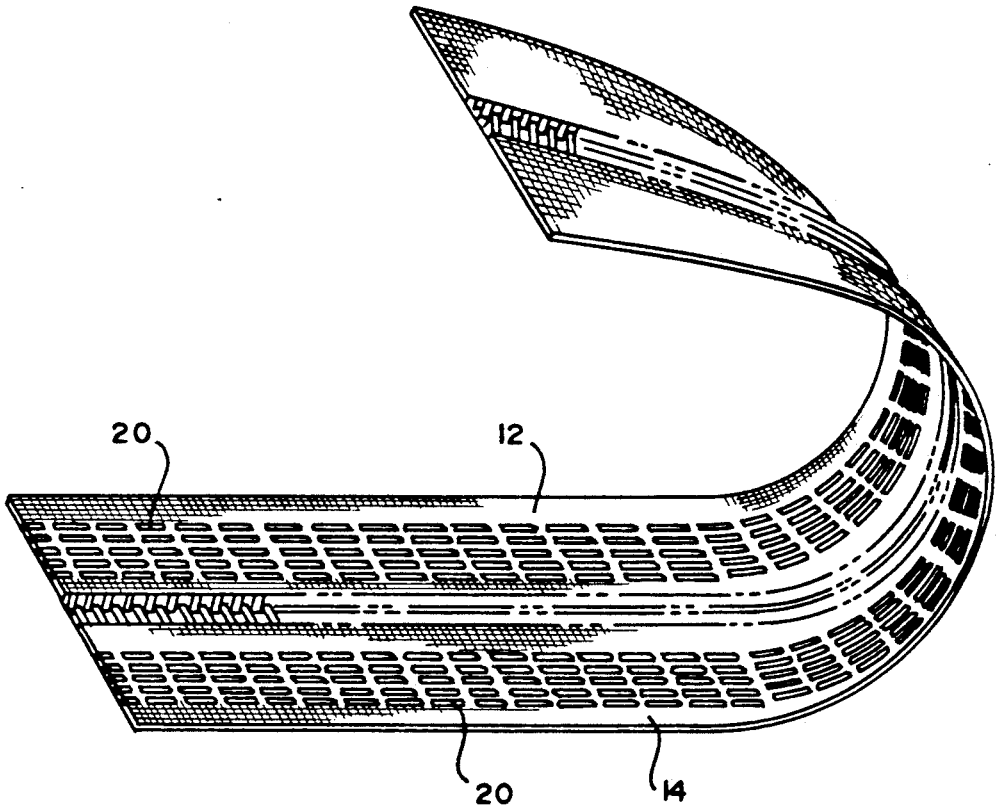
FIG. 3 is a perspective view of the mounting tapes of the zipper showing fusible material woven onto the front side of the tapes.
Figure 4:
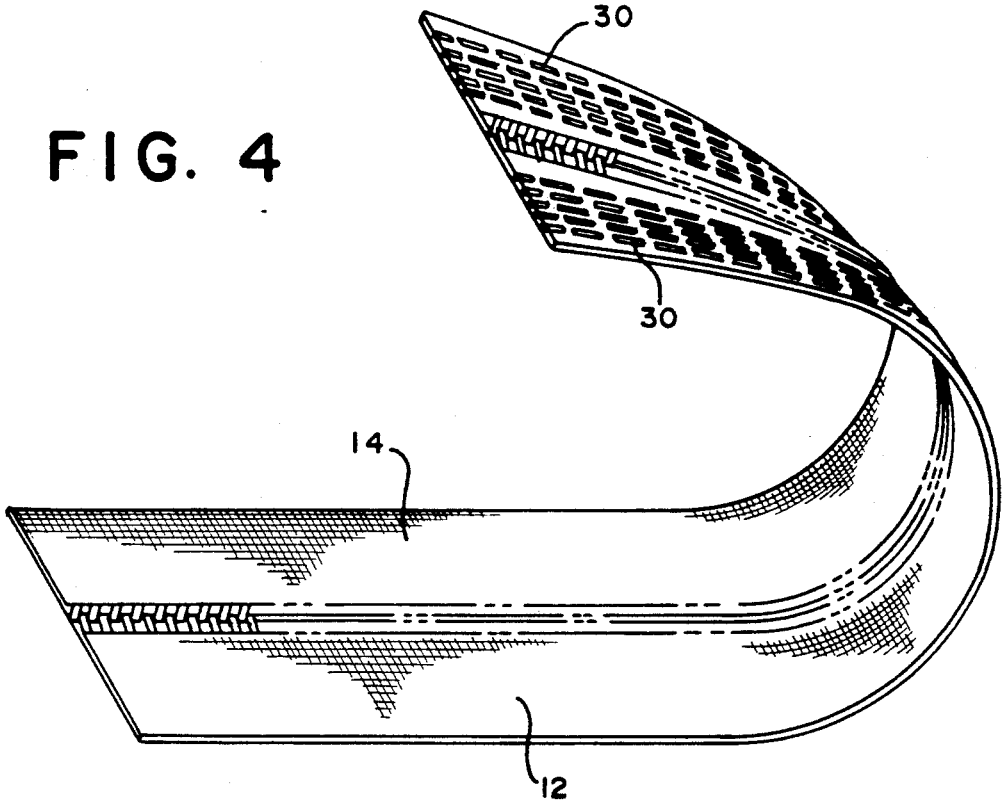
FIG. 4 is a perspective view of the mounting tapes showing fusible material woven into the rear side of the tapes.
Figure 5:
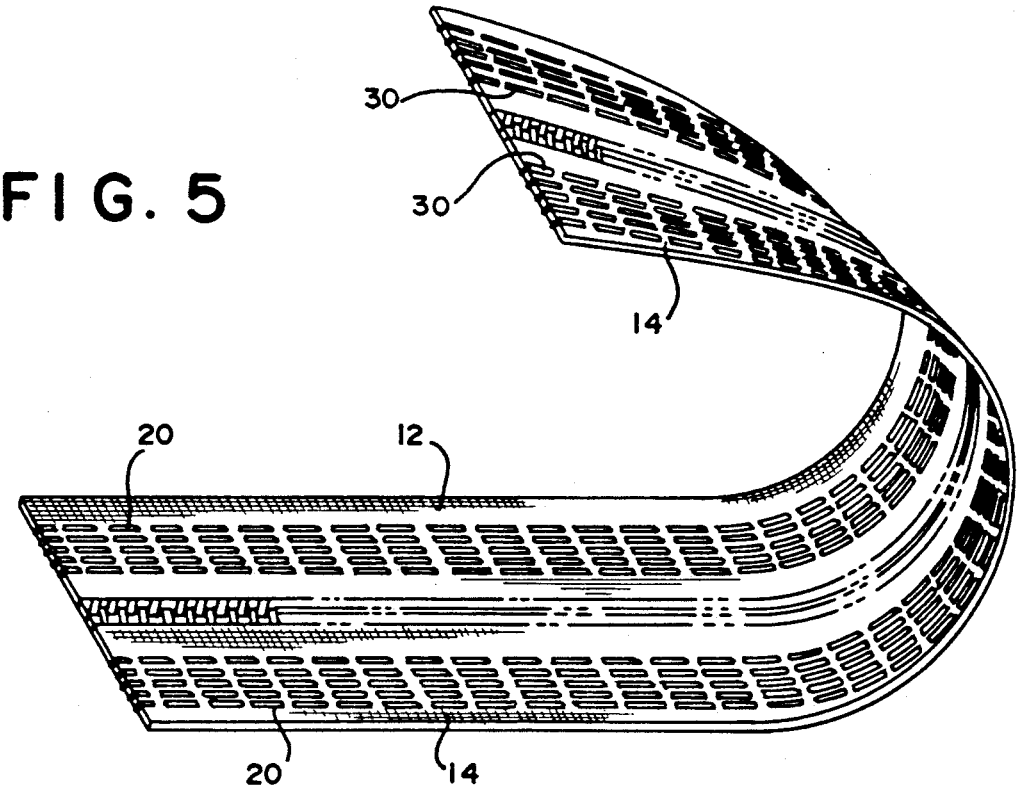
FIG. 5 is a perspective view of the mounting tapes showing fusible material woven into each of the front and rear sides of the tapes.

As is illustrated in FIGS. 3–5, a series of fusible resin coated yarns or monofilaments are woven into the zipper tapes 12 and 14. The yarns or monofilaments may be coated with suitable fusible plastic materials such as polyester, nylon, etc., as well as combinations thereof.

In FIG. 3, a series of five fusible yarns 20 are woven into the front surfaces or sides of the tapes 12 and 14. The number of yarns 20 is not limited to five but any suitable number may be used according to installation requirements. The yarns 20 are shown as being generally centered along the tapes 12 and 14. However, the width of the fusible zone across each tape may be varied also according to installation requirements, for example, from a total width cover to any partial width cover; in addition the yarns need not be centered but may be installed off center as desired or required.

In FIG. 4, a series of 5 fusible yarns 30 are woven into the rear surfaces or sides of the tapes 12 and 14. In FIG. 5, a series of 5 fusible yarns 20 are woven into the front surfaces or sides of the tapes 12 and 14 while a series of 5 fusible yarns 30 are woven into the rear surfaces or sides of the tapes 12 and 14.

While many weave patterns may be used, in the present construction of the tape a woven design is used by means of a 1/1 or 2/2 combination basic weave pattern with a 3/1 combination weave pattern for the fusible yarns. The fusible yarn in the present application utilizes a 220 Denier flat polyester coated with polyvinyl chloride; such yarn is an extrusion coated polyvinyl chloride on a supporting yarn center. After the weaving operation, the entire tape is dyed and the resultant fusible yarns have a contrasting shade making them visibly apparent as the heat sealable portion. The dyed product may create a contrasting heat sealable zone or may match the fabric if desired.

The fusible elements are made from yarns of any textile material with an outer coating of thermoplastic resin of a suitable melt point temperature, i.e., less than the core yarn or a thermoplastic monofilament of suitable stability.

Due to longitudinal stability, the fusible yarn elements may be made part of the fabric structure, substituting the coated yarns for uncoated yarns. The element stability also allows the coated yarns to be added to the basic fabric structure so as to be principally on one face of the fabric. This enhances strength of the bonded interface with other cloth.

Inasmuch as the present invention is subject to many variations, modifications and changes in details, it is intended that all matter contained in the foregoing description or shown in the accompanying drawings, shall be interpreted as illustrative and not in a limiting sense.

We claim:

1. A zipper installation comprising a pair of article sections disposed to define an opening to be closed therebetween, said sections having opposed edge portions adjacent the opening, a zipper having a pair of mounting tapes correspondingly disposed on the edge portions of said pair of sections, each tape being made of woven material having warp yarns and weft yarns, said warp yarns including a series of fusible yarns being parallel and spaced relative to each other, each fusable yarn including a fusible thermoplastic resin coating so that each woven tape is heat sealable to its corresponding article section.

2. The invention as recited in claim 1 wherein said coating is polyvinyl chloride.

3. The invention as recited in claim 2 wherein each tape has a front side and a rear side, and each fusible yarn is woven into the front side of the corresponding tape.

4. The invention as recited in claim 1 wherein each tape has a front side or a rear side, and each fusible yarn is woven into the rear side of the corresponding tape.

5. The invention as recited in claim 1 wherein each tape has a front side and a rear side, and said fusible yarns are woven into the front side and the rear side of the corresponding tape.

6. The invention as recited in claim 1 wherein the warp and weft yarns have a 1/1 and 2/2 combination basic weave pattern, and the fusible warp yarns have a 3/1 combination weave pattern.

7. The invention as recited in claim 6 wherein the mounting tapes are dyed whereby the fusible warp yarns have a contrasting shade of color highlighting the fusible warp yarns.

8. A zipper installation as claimed in claim 1 wherein each fusible yarn includes a core of textile material with a higher melting temperature than the fusible thermoplastic resin coating so as to render the fusible yarns longitudinally stable during heat sealing.

* * * * *